United States Patent [19]

Johnson

[11] Patent Number: 4,649,801

[45] Date of Patent: Mar. 17, 1987

[54] COMPOUND DISPLACEMENT MECHANISM FOR SIMPLIFIED MOTORS AND COMPRESSORS

[76] Inventor: Neil M. Johnson, 9895 Ravenna Rd., Chardon, Ohio 44024

[21] Appl. No.: 721,218

[22] Filed: Apr. 8, 1985

[51] Int. Cl.[4] ..... F01L 33/02

[52] U.S. Cl. ..... 91/194; 123/44 C; 123/44 D

[58] Field of Search ..... 417/465; 418/5, 6, 11; 91/194, 191, 170 R, 173, 176, 196, 197; 73/240; 123/44 R, 44 C, 44 D

[56] References Cited

U.S. PATENT DOCUMENTS

| | | | |
|---|---|---|---|
| 1,622,816 | 3/1927 | Sperry | 91/173 |
| 1,853,394 | 4/1932 | Appel . | |
| 1,890,560 | 12/1932 | Burn | 91/173 |
| 2,018,692 | 10/1935 | Waite . | |
| 3,056,356 | 10/1962 | Piper . | |
| 3,279,445 | 10/1966 | Karol | 123/44 D |
| 3,630,178 | 12/1971 | Erickson . | |
| 4,307,695 | 12/1981 | Vasilantone . | |
| 4,325,331 | 4/1982 | Erickson . | |
| 4,377,136 | 3/1983 | Evans . | |

FOREIGN PATENT DOCUMENTS

| | | | |
|---|---|---|---|
| 1176919 | 8/1964 | Fed. Rep. of Germany | 123/44 C |
| 874492 | 8/1942 | France . | |
| 7715468 | 8/1978 | France . | |
| 7405297 | 10/1975 | Netherlands . | |

*Primary Examiner*—Michael Koczo
*Assistant Examiner*—Richard R. Cole
*Attorney, Agent, or Firm*—Renner, Otto, Boisselle & Lyon

[57] ABSTRACT

A rotating and reciprocating positive displacement mechanism which draws in a metered volume of gas and then expands or compresses that quantity of gas before expelling it. The mechanism has useful application as a compressor, a compressed gas motor, an expanding vapor engine, or a hot gas engine, where generation of heat by combustion can be either internal or external to the expansion mechanism. The primary advantages of the mechanism over conventional mechanisms used in these applications include (1) few moving parts, (2) easily constructed parts of simple geometry, (3) feasibility of compound operation (i.e. two-stage expansion or compression), (4) relatively constant input or output torque throughout the operating cycle, and (5) relative absence of high pressure peaks during the operating cycle (even when used as an internal combustion engine).

13 Claims, 9 Drawing Figures

COMPOUND DISPLACEMENT MECHANISM FOR SIMPLIFIED MOTORS AND COMPRESSORS

The invention herein disclosed relates generally to rotating displacement mechanisms.

BACKGROUND

Hot gas engines in general utilize the approximately ideal relationship between the pressure, volume, and temperature of gases (i.e. $PV=nRT$) to control conversion of heat to mechanical power. Internal combustion engines in particular take in a given volume of air at ambient temperature, raise the temperature of that air very rapidly by igniting a small quantity of fuel evaporated or dispersed in it, and provide for a certain amount of mechanical expansion of the hot combustion products to recover some pressure-volume work before the hot gases are expelled from the engine.

An *ideal* engine/transmission system will recover the maximum amount of work from fuel consumes, at any rate dictated by the need for power, using a simple and easily constructed mechanism of minimum weight. Conventional internal combustion engines, based upon the piston-and-bellcrank displacement mechanism in common use since the time of James Watt, fall far short of the ideal performance largely because of a limited number of practical considerations:

Combustion Kinetics: Because fuel droplets or particles evaporate and burn at finite rates, the temperature of exhaust gases must be somewhat less than the value calculated from thermodynamic properties of the fuel and the air/fuel ratio; the discrepancy increases as engine speed is increased because less time is available for completion of combustion within the engine.

Mechanical Constraints: Because the intake and power stroke displacements of a typical piston-and-bellcrank engine are exactly the same, the combustion gases are still at a high pressure at the end of a power stroke. Escape of this high pressure gas when an exhaust valve opens generates considerable noise and forfeits a significant portion of the pressure-volume work which could have been recovered if the power stroke displacement were sufficiently larger than intake displacement to exhaust the hot combustion gases at ambient pressure.

Load Characteristics: Because the displacement of an engine is specified primarily on the basis of its peak power requirement, any effective means of averaging the load requirements will permit use of a smaller engine, with corresponding reductions in weight and fuel consumption. Furthermore, complex multicylinder engines with flywheels of relatively low rotational inertia are commonly used whenever the engine is expected to change speed rapidly under load, whereas a much simpler and more efficient one-cylinder engine of comparable displacement driving a large heavy flywheel at constant speed could be used to supply the same amount of power if speed variations could be accomplished by a transmission instead of by the engine. Load averaging depends on the ability of a power transmission system to store or withdraw energy from a storage device (e.g. battery, compressed air tank, flywheel, etc.) while continuing to transmit the precise amount of power needed to satisfy the load requirements.

Material Limitations: Because common metallic materials require cooling and lubrication to prevent galling and oxidation of sliding surfaces in an engine, approximately 30% of available combustion heat must be wasted through conduction to a cooling system simply to prevent a conventional engine from destroying itself.

SUMMARY OF THE INVENTION

The invention described here is a rotating and reciprocating mechanism for expanding or compressing gas. This invention has useful application as a compressor, a compressed gas motor, an expanding vapor engine, or a hot gas engine, where generation of heat by combustion can be either internal or external to the engine.

The rotating and reciprocating mechanism of the subject invention is an adaptation of the Tri-Rotor pump (Tri-Rotor, Inc., 36 E. Lawton St., Torrington, Conn. 06790), the use of which pump appears to date back to the Second World War era. More particularly, the eccentric shuttle of the present invention is an adaptation of that pump's shuttle and can be compounded with the piston displacement by porting and channels through the rotor and the block as hereinafter described.

The structural components of the subject mechanism are generally similar to those shown in U.S. Pat. No. 3,279,445, issued to Robert Karol on Oct. 18, 1966. Karol, however, made no use of the relative reciprocation of his shuttle within the slot in the piston as a second displacement mechanism; the only function of his shuttle was to provide a suitable bearing surface for guiding the motion of his piston within the rotor slot. His mechanism with just three moving parts consequently had only one double-acting piston and was capable only of two-cycle, but not four-cycle, operation without the use of valves. When he added a second piston, the Karol engine with four moving parts could have been adapted to four cycle operation without valves, but no means for the required transfer of gases between displacement spaces was described.

Although the detailed description of the operation of this mechanism here is related primarily to application as a heat engine, it is understood that the minor modifications in porting necessary for its use in the other applications could be effected by one skilled in the art.

In the mechanism employed for use as a hot gas engine according to the invention, a fuel/air mixture is admitted to a space displaced by the eccentric shuttle on its intake stroke, then compressed on its compression stroke. The compressed mixture is then discharged with considerable turbulence through a port on the transfer plate pilot boss to a passageway containing a continuous ignition source (e.g. a glowing filament or a catalytic matrix) so that combustion is much smoother than if it were initiated by an instantaneous spark. The burning gas is then led to a space displaced by the piston to produce useful work, and it is finally exhausted at relatively low pressure because piston displacement is much larger than displacement of the eccentric shuttle.

DETAILED DESCRIPTION

Figure 1:
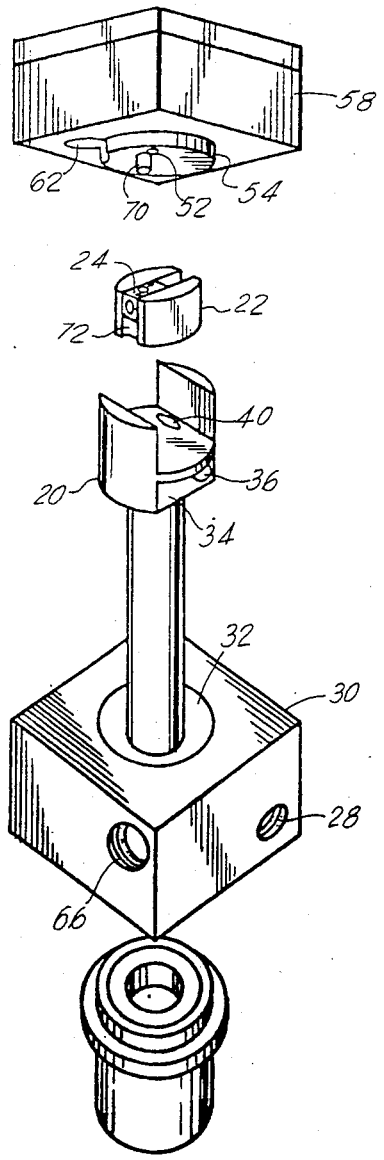
FIG. 1 is an exploded drawing of a displacement mechanism according to the invention.
Figure 1A:
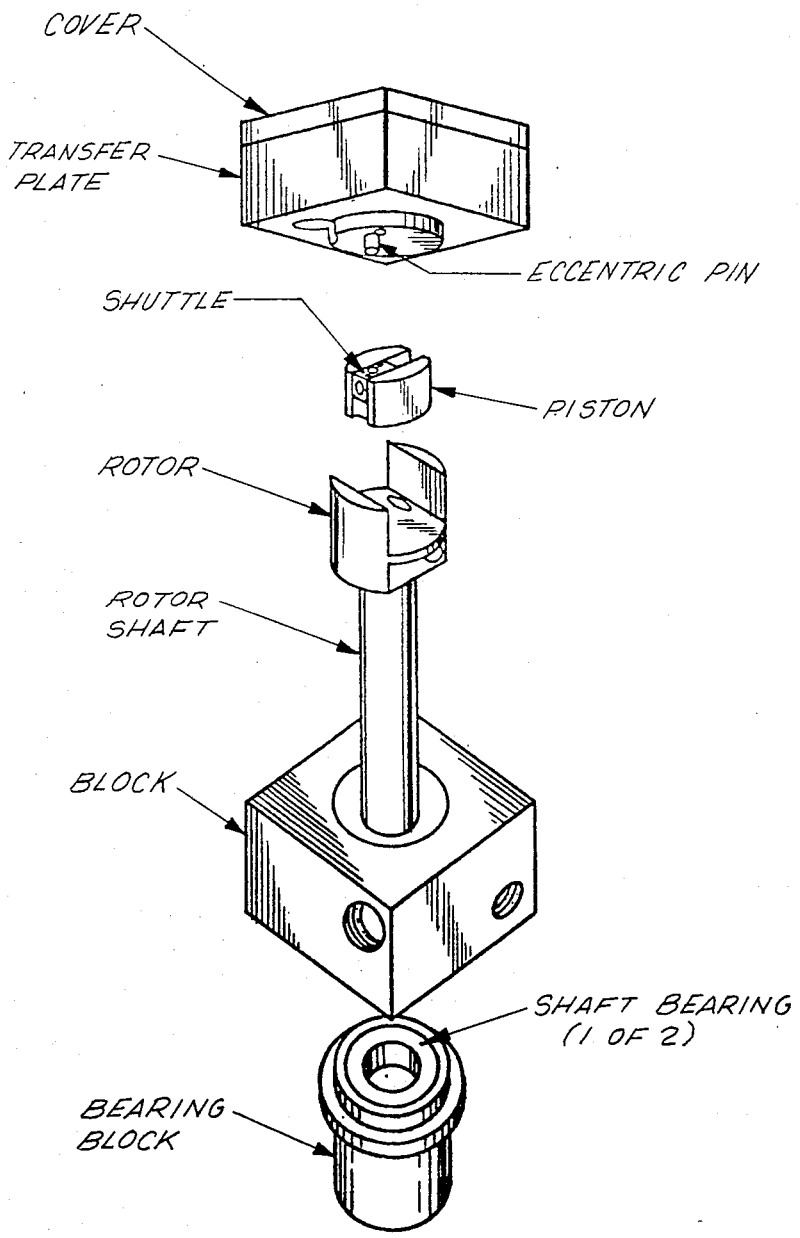
FIG. 1A is a terminology drawing—parts.
Figure 1B:
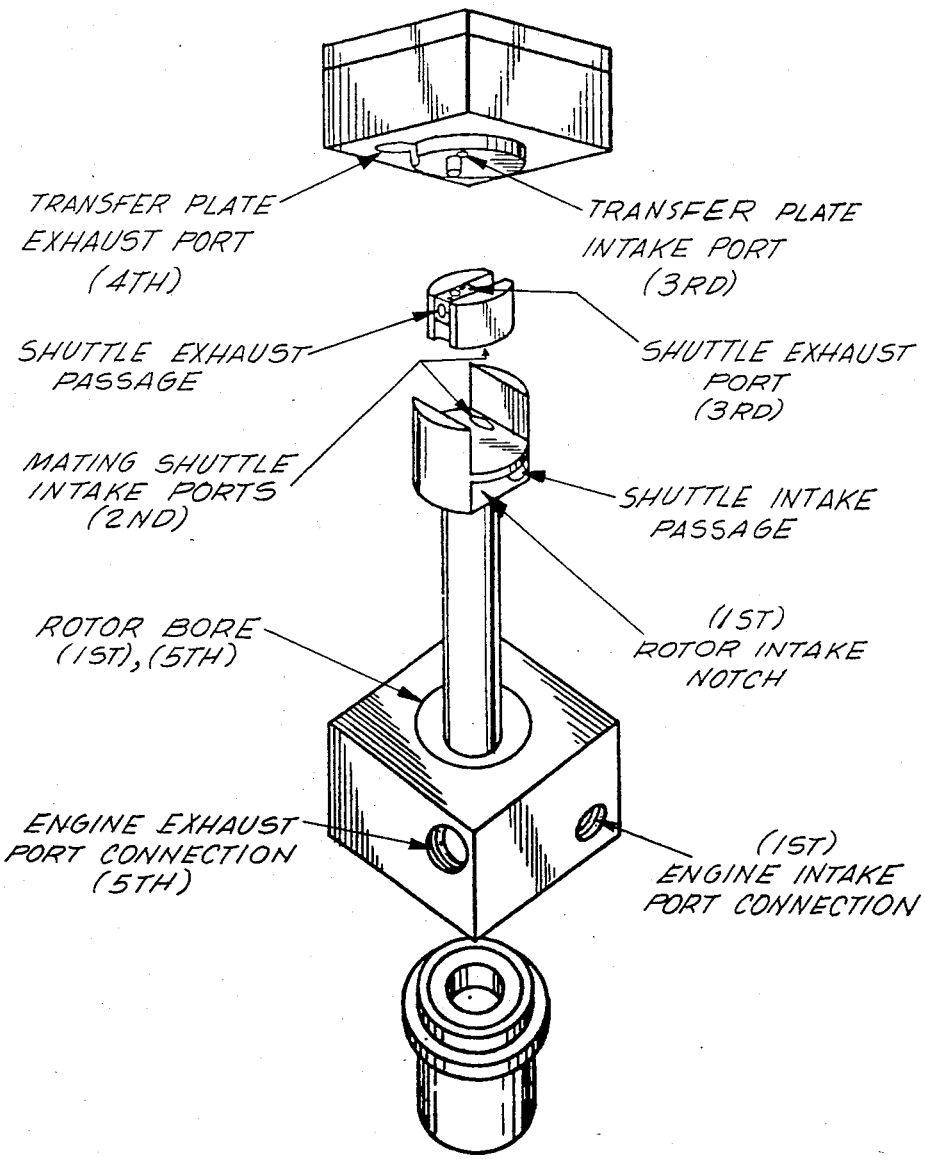
FIG. 1B is a terminology drawing—porting.
Figure 1C:
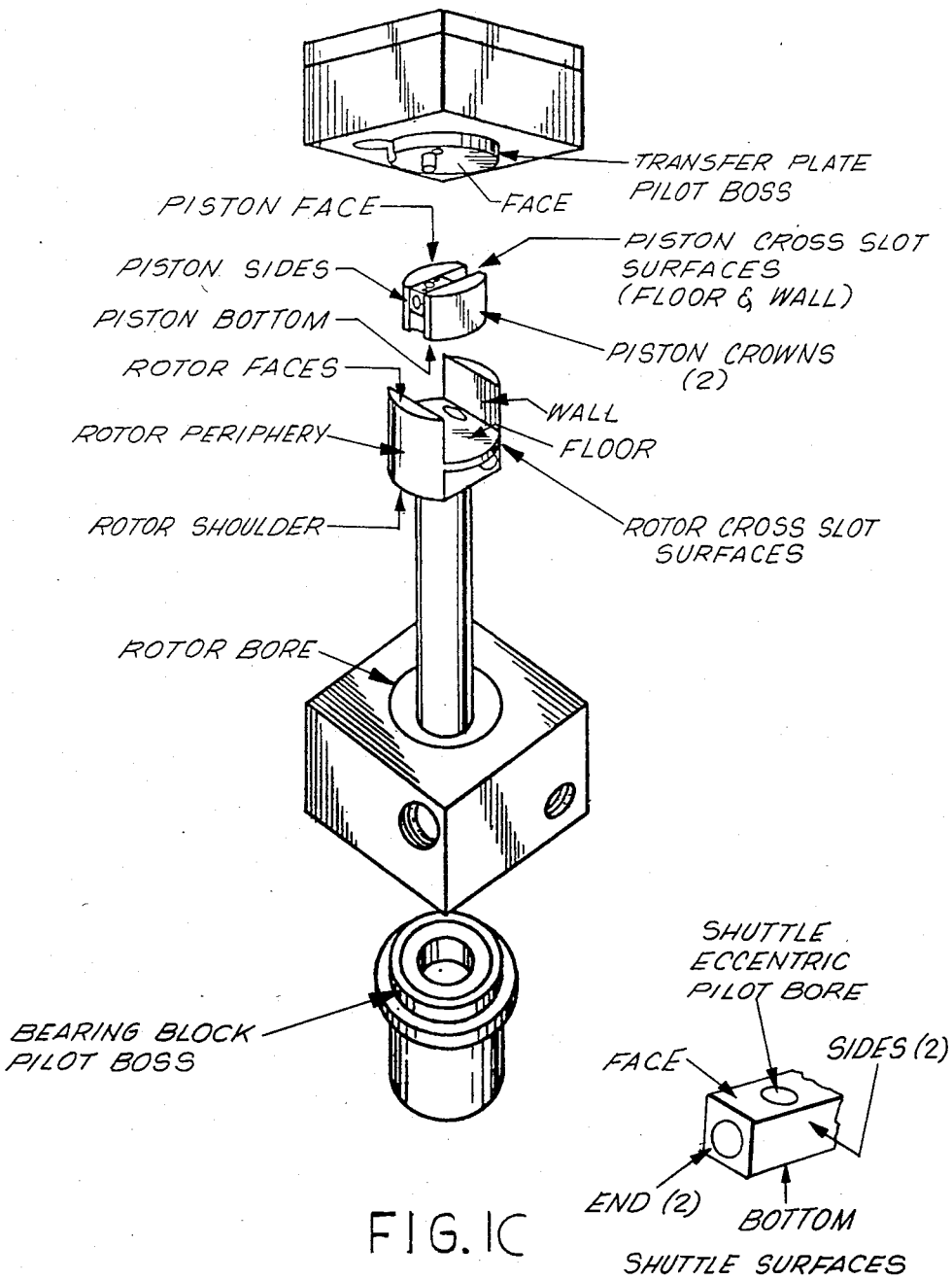
FIG. 1C is a terminology drawing—sliding surfaces.

Referring to FIG. 1, an exploded view showing the relationships between parts, one can observe that the rotor/shaft 20, the piston 22, and the shuttle 24 are the only parts which move during operation of the mechanism. One will also notice that there are no valves and no valve actuation mechanisms; the flow of gas through the mechanism is controlled entirely by displacements and intermittent alignment of ports resulting from relative motions of the rotor 20, piston 22, and shuttle 24 with respect to each other and to adjoining stationary parts.

Figure 2:
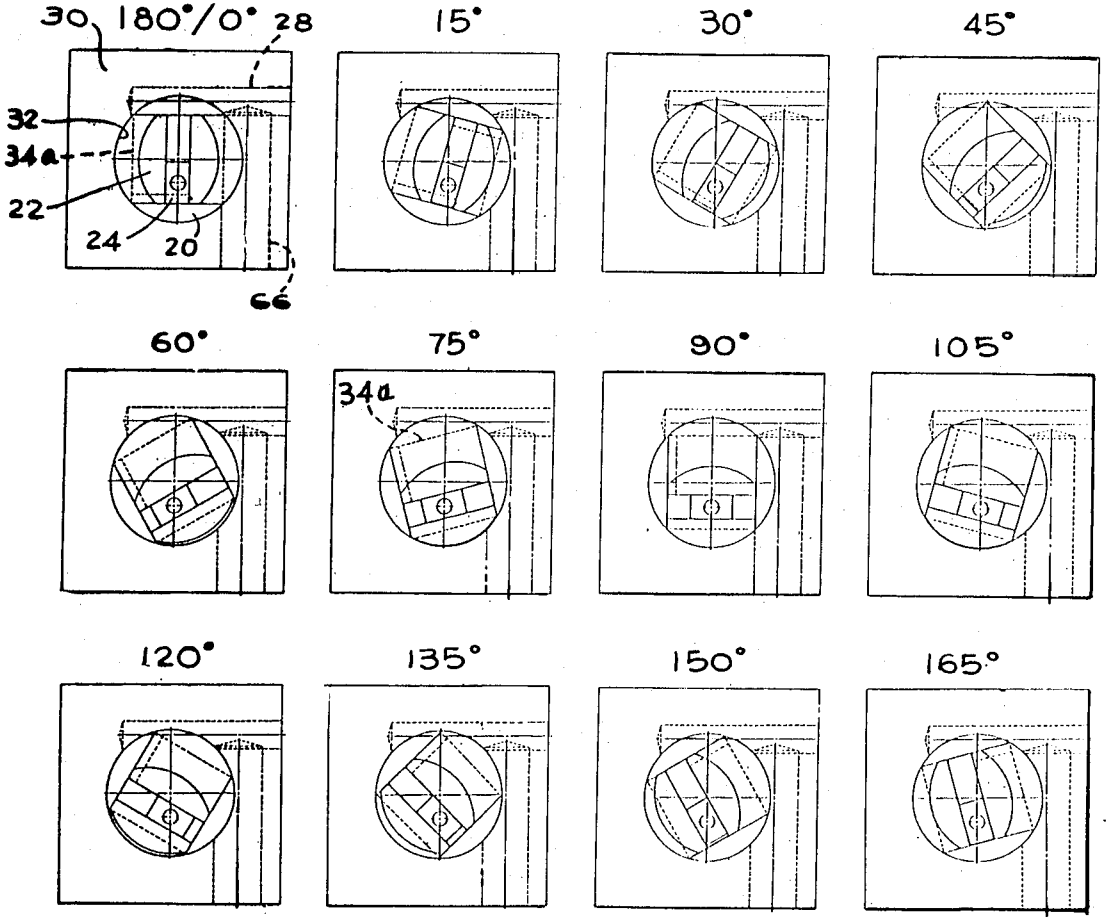
FIG. 2 is a sequence diagram in 15° increments of clockwise rotor rotation.

Referring now to FIG. 2, a sequential series of drawings showing the relative positions of the rotor face, piston face, and shuttle face at 15° increments of rotor rotation. It is readily seen that both the piston 22 and the shuttle 24 function as double-acting pistons, each 90° out of phase with the other, and widely differing in their displacement volume. The 90° difference in phase provides time for transfer of gas from one displacing body to the other, without compromising the double-acting characteristic of either body, thereby permitting expansion or compression of gas in two stages with a minimum number of moving parts; comparable compound expansion or compression of two volumes of gas per revolution in a conventional bellcrank-and-piston mechanism, by contrast, would require four pistons, four connecting rods and a crank, or a total of nine moving parts, plus any additional parts which might be required to perform the valving function.

OPERATION AS A HOT GAS ENGINE

Although the detailed description of the operation of this mechanism here is related primarily to application as a heat engine, it is understood that the minor modifications in porting necessary for its use in the other applications could be effected by one skilled in the art.

SHUTTLE INTAKE STROKE

An air/fuel mixture is supplied from a carburetor or other suitable mixing device to an engine intake port connection 28, which penetrates the block 30 and intersects the rotor bore 32 at a point which is isolated at all times from the space displaced by the piston 22, but which corresponds to the surface of the rotor 20 near its shoulder. Two diametrically opposed rotor intake notches 34 are cut into the cylindrical surface of the rotor 20 near the rotor shoulder at an axial position such that each notch 34 and the engine intake port connection 28 in the block constitute the first set of intermittently aligned ports. The engine intake port connection 28 and the two rotor intake notches 34 are sized and positioned such that their intermittent alignment allows the fuel/air mixture to flow through to one of two shuttle intake passages 36 in the rotor 20 only during the half rotation when that shuttle intake passage 36 is required to supply a quantity of the fuel/air mixture to an intake stroke of its respective end of the shuttle 24.

When either end of the shuttle 24 approaches completion of an intake stroke, the piston 22 is simultaneously moving at its maximum rate and approaching the midpoint of its travel. A second set of intermittently aligned shuttle intake ports including ports 40 on the floor 42 of the rotor cross-slot and ports 44 on the piston bottom 46 are shaped and positioned such as to present a large alignment cross-section throughout the intake stroke of the corresponding end of the shuttle 24; the loss of port alignment at the midpoint of piston travel abruptly and precisely terminates the flow of fuel/air mixture from the shuttle intake passage 36 in the rotor to one end of the shuttle 24 at the completion of the corresponding shuttle intake stroke. At this point the rotor has rotated 180° since the beginning of the shuttle intake stroke.

SHUTTLE COMPRESSION/TRANSFER STROKE

At 180° of rotation of the rotor 20, the shuttle 24 reverses direction and begins to compress the recently acquired volume of fuel/air mixture. At some point between 180° and 360° of rotor rotation, a third set of intermittently aligned ports including port 50 in the face of the shuttle and port 52 in the transfer plate pilot boss 54 become aligned and allow the compressed mixture to escape into a passageway 56 in the transfer plate 58. By the time the rotor has rotated 360°, the third set of intermittently aligned ports 50, 52 will have already closed, so that the compressed gas in the transfer plate intake port 52 cannot escape through the shuttle and reduce the volumetric efficiency of the succeeding shuttle intake stroke, which is just beginning.

IGNITION

At 360° of rotor rotation, intake and compression of the fuel/air mixture have already occurred, and the mixture has entered a transfer passage 56 in the transfer plate 58, which then leads to a space 60 displaced by the piston. It can be seen from the incremental sequence diagram (FIG. 6—360° Rotation), however, that the piston 22 is already at midstroke and has already displaced a volume several times greater than the entire volume displaced by the shuttle on its compression/-transfer stroke. If one wishes to avoid rotational deceleration of the engine resulting from development of a partial vacuum at any time during the piston's power stroke, the fuel/air mixture must be ignited and the buring mixture allowed to enter, through a fourth set of intermittently aligned ports (described below), the space 60 displaced by the piston at or near the very beginning of its power stroke.

The ignition process need not be precisely timed, because the mixture cannot ignite until the third set of intermittently aligned ports 50, 52 allows it to approach an ignition source provided in the transfer passage 56, and because the large receding piston face is increasing the available expansion volume many times faster than the small advancing shuttle face is decreasing it. It is possible, indeed very desirable, to provide a continuous source of ignition in the transfer passage 56 in order to avoid the extremely high peak pressures typically encountered in conventional engines, while simultaneously permitting both the structural requirements and the weight of the engine to be reduced.

Such a continuous source of ignition can include an incandescent coil of wire operating at relatively low voltage, suitable for starting the engine when it is cold; this arrangement is much simpler, much cheaper, and probably more reliable than the coil, contact points, distributor, and high voltage wiring commonly used as the spark ignition system for a conventional gasoline engine.

A porous matrix of heat resistant material, impregnated with a catalyst which lowers the activation energy for oxidation of the fuel, can be a suitable source of continuous ignition when the engine is hot and has been operating for some time; this arrangement not only ignites the fuel/air mixture, but it improves the fuel efficiency of the engine by reducing the amount of unburned fuel entrained in the hot gases exhausted from it.

COMBUSTION

If the fuel/air mixture is ignited by a continuous ignition source as it first enters the transfer plate intake port 52, combustion is free to occur at a rate determined by the volatility and heat content of the fuel as the burning mixture passes through the transfer passage 56. If the transfer plate intake port 52 is sufficiently small in diameter so that the velocity of the fuel/air mixture within it exceeds the rate of propagation of the flame front, continuous combustion is forced to occur within the transfer passage 56 without danger of damage to the engine because of premature detonation and high pressure transients.

It can be readily seen from the exploded view of the engine that the volume of any transfer passage 56 within the transfer plate 58 is independent of the operating geometry of the shuttle 24 or the piston 22. The engine designer can make this volume as large or as small as he wishes, in order to provide adequate time to achieve complete combustion of practically any fuel. For example, a low speed engine burning natural gas in air will run quite well with essentially no residence time in the transfer passage 56, whereas a high-speed engine burning fuel oil or an engine burning micronized coal dust in air might require connection of an adiabatic labyrinth of considerable size to the transfer passage 56 in order to provide a residence time long enough to achieve complete combustion of the slower burning fuels.

It should be noted that, as the residence time is increased by increasing the volume of the transfer passage 56, the engine will become progressively less tolerant to changes in load. Furthermore, the engine designer must provide some positive means for limiting the amount of hot pressurized gas escaping from the transfer passage 56 with each piston power stroke, so that each piston power stroke receives no more gas than piston displacement can expand to near ambient pressure. This is the function of the fourth set of intermittently aligned ports, to be described below. The elevated pressure within the transfer passage 56 can thereby be maintained within narrow limits during most operating conditions, and control of engine speed can be controlled by varying the fuel/air ratio admitted to the engine intake port connection 28.

PISTON POWER STROKE

The power stroke of the piston 22 begins at 270°, when the shuttle 24 is at the midpoint of its compression/transfer stroke and when the third set of intermittently aligned ports 50, 52 is just beginning to allow the compressed mixture to escape past an ignition source in the transfer passage 56 toward a space 60 displaced by the piston. The fourth set of intermittently aligned ports including a port 62 at the edge of the transfer plate pilot boss 54 and the periphery 64 of the rotor face allows the hot pressurized gases in the transfer passage 56 to escape into the space 60 displaced by the piston only during the rotation interval from 270° to some point equal to or prior to 450°; the engine designer can design the fourth set of ports in such a manner that any average pressure at or above ambient can be maintained within the transfer passage while still allowing the piston to expand the hot gas to a pressure at or near ambient at the end of the power stroke.

Since the displacement during the power stroke of the piston 22 may exceed the volume required to expand the gaseous combustion products to ambient pressure under a number of circumstances (such as starting, idling, or operation under very cold conditions or with contaminated fuel), the engine designer may wish to connect a check valve at some point along the rotor bore 32 in the block 30 between the transfer plate exhaust port 62 and the engine exhaust port connection 66, in order to minimize rotational deceleration and prevent stalling of the engine by admitting cool ambient air to the space 60 displaced by the piston during a power stroke whenever pressure there drops below ambient.

PISTON EXHAUST STROKE

When the piston 22 completes its power stroke at 450° of rotor rotation after the beginning of the corresponding shuttle intake stroke, the hot gases have expanded to a pressure relatively close to ambient. As the piston reverses direction in order to begin its exhaust stroke, a fifth set of intermittently aligned ports allows the hot gases to escape from the rotor cross slot into the engine exhaust port connection 66. Because the pressure of the hot gases is relatively close to ambient, the gases escape slowly and generate so little noise that no additional muffling device need be provided in the exhaust duct. The fifth set of intermittently aligned ports (consisting of the open side of the cross slot and a port at the inside wall of the rotor bore 32) continues to permit escape of hot exhaust gases throughout the exhaust stroke until the piston again reverses direction and is ready to begin another power stroke at 630° of rotor rotation.

OPPORTUNITIES FOR COMBINED CYCLE OPERATION

Since the efficient operation of an internal combustion engine depends upon maintaining the gaseous combustion products at as high a temperature as possible until the end of the power stroke, it follows that a more efficient engine will improve the opportunity to operate some sort of combined cycle, increasing efficiency still further by using the rejected heat in the engine exhaust.

For example, if the temperature of combustion products as they are exhausted from the engine can be raised 100° C. by constructing the engine of materials with low thermal conductivity and by eliminating the engine's cooling system, the temperature differential across a heat exchanger to recover waste heat from the exhaust gases also rises by 100° C. If the heat exchanger is used to boil water or some other liquid in order to provide vapor to supplement the pressure against the piston during its power stroke, one can expect a net improvement in engine efficiency, because only waste heat need be utilized to generate the vapor with only a minimal increase in back pressure. Opportunity for the vapor to moderate the combustion processes and prevent accumulations of carbon deposits within the combustion spaces can be expected to provide additional benefits as well.

SUMMARY OF INTERMITTENTLY ALIGNED PORTS

Since the displacement motion of the piston within the rotor, constrained by bearing surfaces on a rotating shuttle, is described by prior art, and since the present invention primarily is directed to the use of the relative motion of the shuttle within the piston for displacing gas, it is particularly important to understand the operating details and functions of the five sets of intermittently aligned ports.

TABLE I

Summary of Operation of Intermittently Aligned Ports

| Set | Mating Surfaces | Interval | Function |
|---|---|---|---|
| 1st | Engine intake connection and rotor shoulder | 0–180° | Maintain a volume of fuel/air mixture at nearly ambient pressure at a point convenient for intake by shuttle with minimum viscous drag. |
| 2nd | Rotor floor and piston bottom | 0–180° | Provide quick opening and quick closing of a passage of minimum restriction for shuttle intake strokes. |
| 3rd | Shuttle face and transfer plate pilot boss | ca. 270° to 360° | Permit escape of compressed fuel/air mixture from shuttle past an ignition source to piston expansion space. |
| 4th | Rotor face and transfer plate pilot boss | ca. 270° to ca. 315° | Admit controlled amount of hot gas to piston expansion space. |
| 5th | Rotor periphery and engine exhaust connection | 450–630° | Permit piston exhaust stroke to expel entire volume of hot combustion products. |

FIG. 2 is a sequence of diagrams showing the positions of the rotor 20, piston 22, and shuttle 24 relative to the block 30 in 15° increments of rotor rotation. The engine intake port connection 28 is shown by a hidden line extending across the top of the rotor bore 32 and subtending a 90° arc at the rotor circumference. The two rotor intake notches 34 are shown by hidden lines on the rotor cross slot floor, which also subtend 90° arcs about the rotor axis. The combination of these two details constitutes the first set of intermittently aligned ports. It can be seen from the sequence of diagrams that the rotor intake notch 34*a* which is about to make connection with the engine intake port at 0° rotation will remain in connection with it until 180° rotation. One or the other of the rotor notches is positioned to receive the intake gas mixture from the engine intake port connection at all times during rotation of the rotor.

Figure 3:
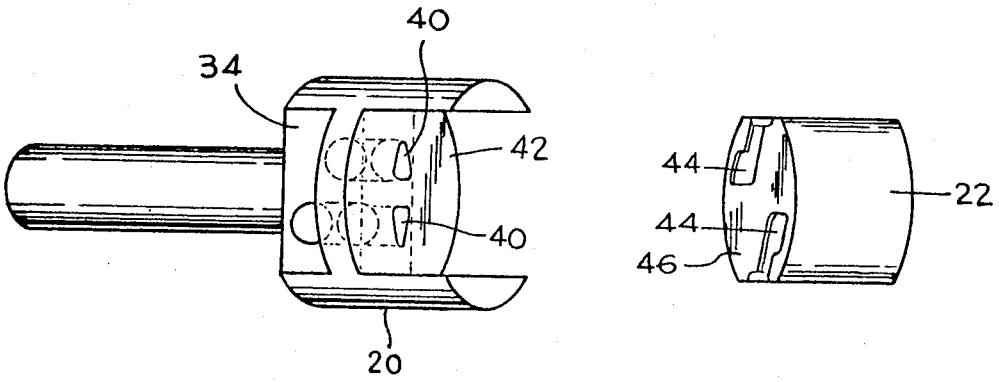
FIG. 3 is an exploded drawing of piston and rotor, showing the second set of intermittently aligned ports.

FIG. 3 is an exploded drawing of the rotor 20 and piston 22, showing the shape and relative positions of the mating surfaces of the second set of intermittently aligned ports.

Figure 4:
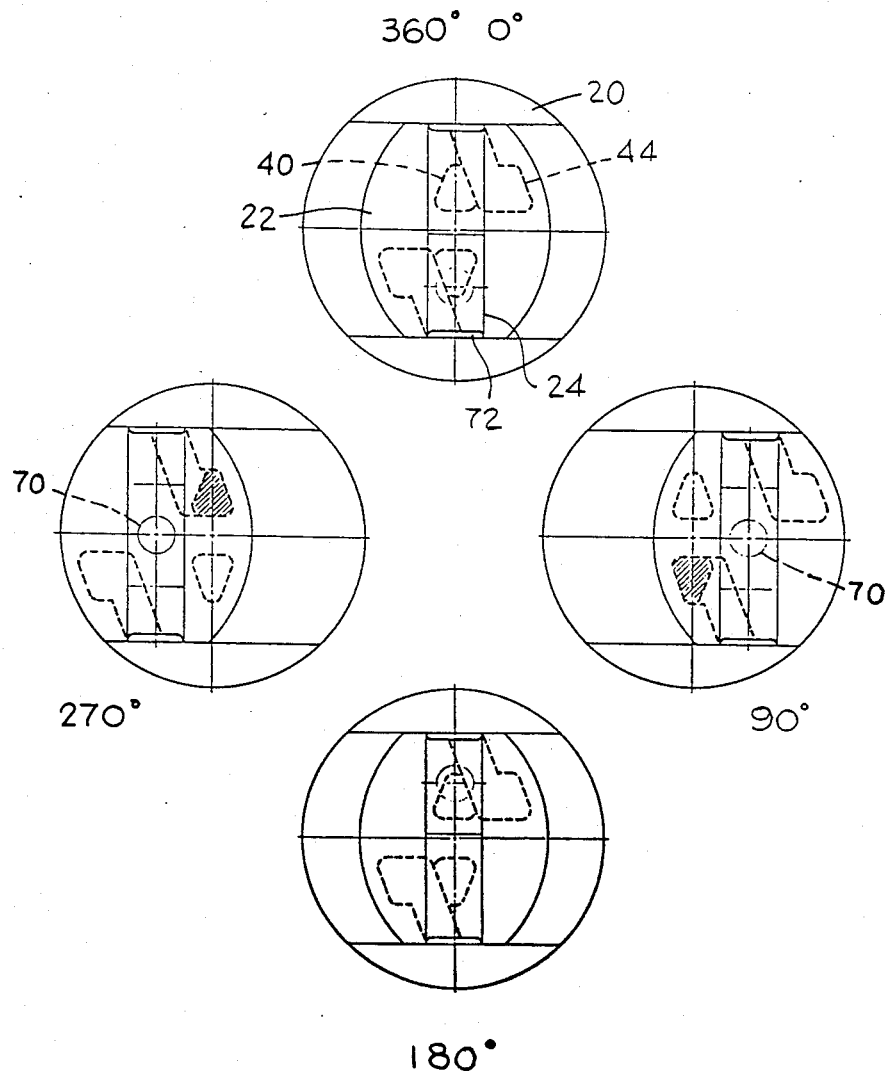
FIG. 4 is a sequence diagram in 90° increments of clockwise rotor rotation, showing operation of the second set of intermittently aligned ports.

FIG. 4 shows the operation of the second set of intermittently aligned ports, as seen from a vantage point within the transfer plate, at 90° increments of rotor rotation; for purposes of illustration, the rotor 20 is held fixed and the rotor block 30 and eccentric pin 70 are caused to rotate relative to it. The mating portions of the second set of intermittently aligned ports are shown superimposed as hidden lines upon the faces of the piston and shuttle. The approximately triangular holes 40 penetrate the floor of the rotor cross slot and connect with the engine intake port connection 28 via the corresponding shuttle intake passages 36 and rotor intake notches 34; the approximately flag-shaped holes 44 are recessed into the bottom of the piston and connected to their respective shuttle intake strokes by grooves 72 at the ends of the piston cross slot. It can be seen that the two mating cavities near the bottom of the 0° diagram are just approaching conjunction and that this conjunction will occur rapidly because the piston 22 is at the midpoint of its stroke and moving at the maximum rate permitted by its sinusoidal motion relative to the rotor 20. The cross-hatched area in the 90° diagram shows the large cross sectional area and minimal viscous drag through the port conjunction at a time when the shuttle is drawing in gas at its maximum rate at the midpoint of its sinusoidal motion within the piston cross slot. The 180° diagram shows the abrupt termination of this conjunction at precisely the time when conjunction of the opposite set of ports is just beginning. The 270° diagram shows that the quantity of gas being compressed by the shuttle in preparation for its transfer past an ignition source cannot escape back into the shuttle intake passage at any time during the interval from 180° to 360°; the engine intake port connection continues to supply gas for an intake stroke of the opposite end of the shuttle throughout this interval, however.

Figure 5:
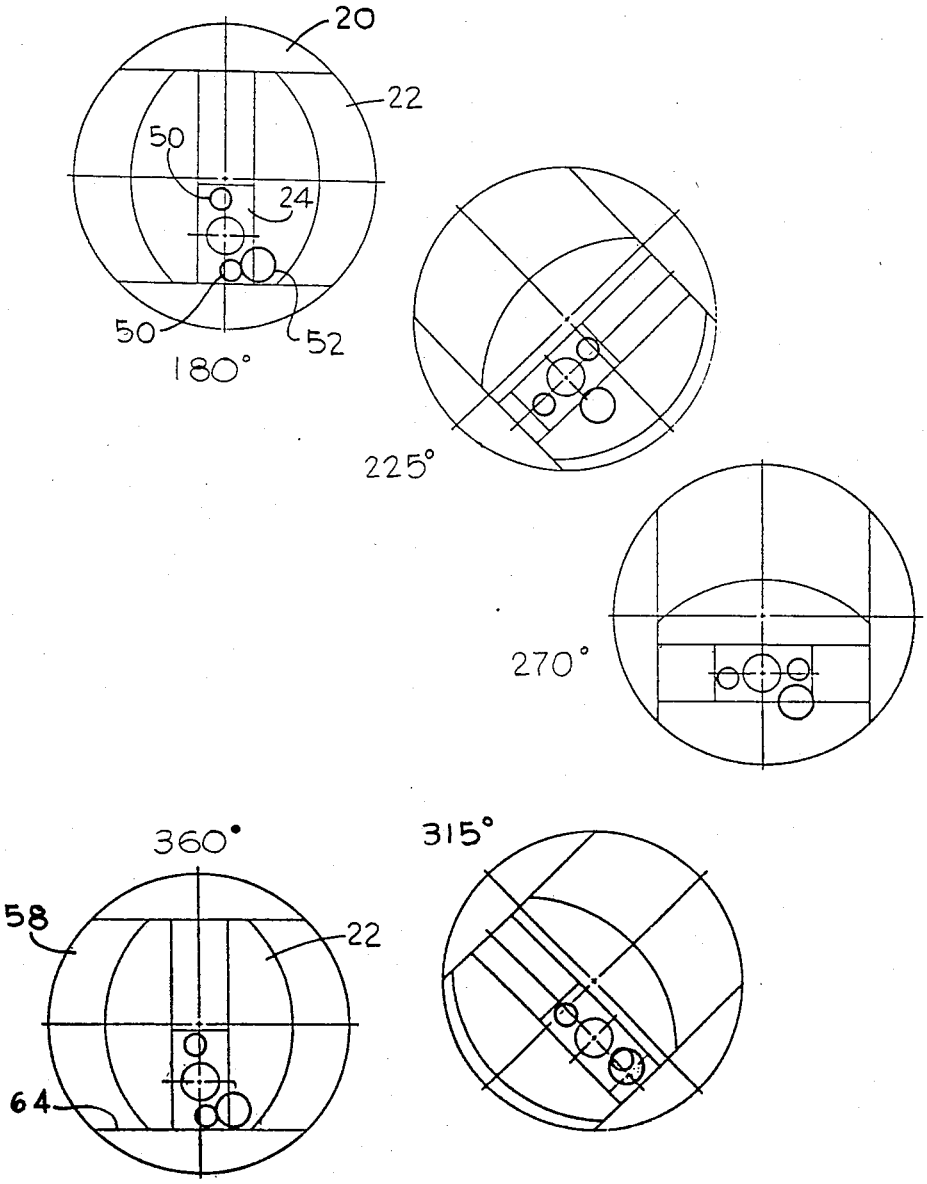
FIG. 5 is a sequence diagram in 90° increments of clockwise rotor rotation, showing operation of the third set of intermittently aligned ports.

FIG. 5 shows the operation of the third set of intermittently aligned ports, as seen from a vantage point within the transfer plate, in 45° increments of rotor rotation. The two small holes 50 on the face of the shuttle 24 penetrate the body of the shuttle and their respective shuttle crowns (ends) and provide auxiliary passageways to increase the effective cross section for flow of the fuel/air mixture during conjunction of the mating cavities. The large hole 52 to the lower right (FIG. 5—180°) of the eccentric pin penetrates the surface of the transfer plate and provides a passage for gas to reach a source of ignition within a stationary combustion chamber 56. It can be easily seen that (1) conjunction does not occur until some time after 270° of rotor rotation past the beginning of the corresponding shuttle intake stroke, and (2) that conjunction has already been terminated by the time the rotor reaches the 360° point. The large flow cross section during conjunction is illustrated by the cross-hatched area on the diagram corresponding to 315° of rotor rotation.

Figure 6:
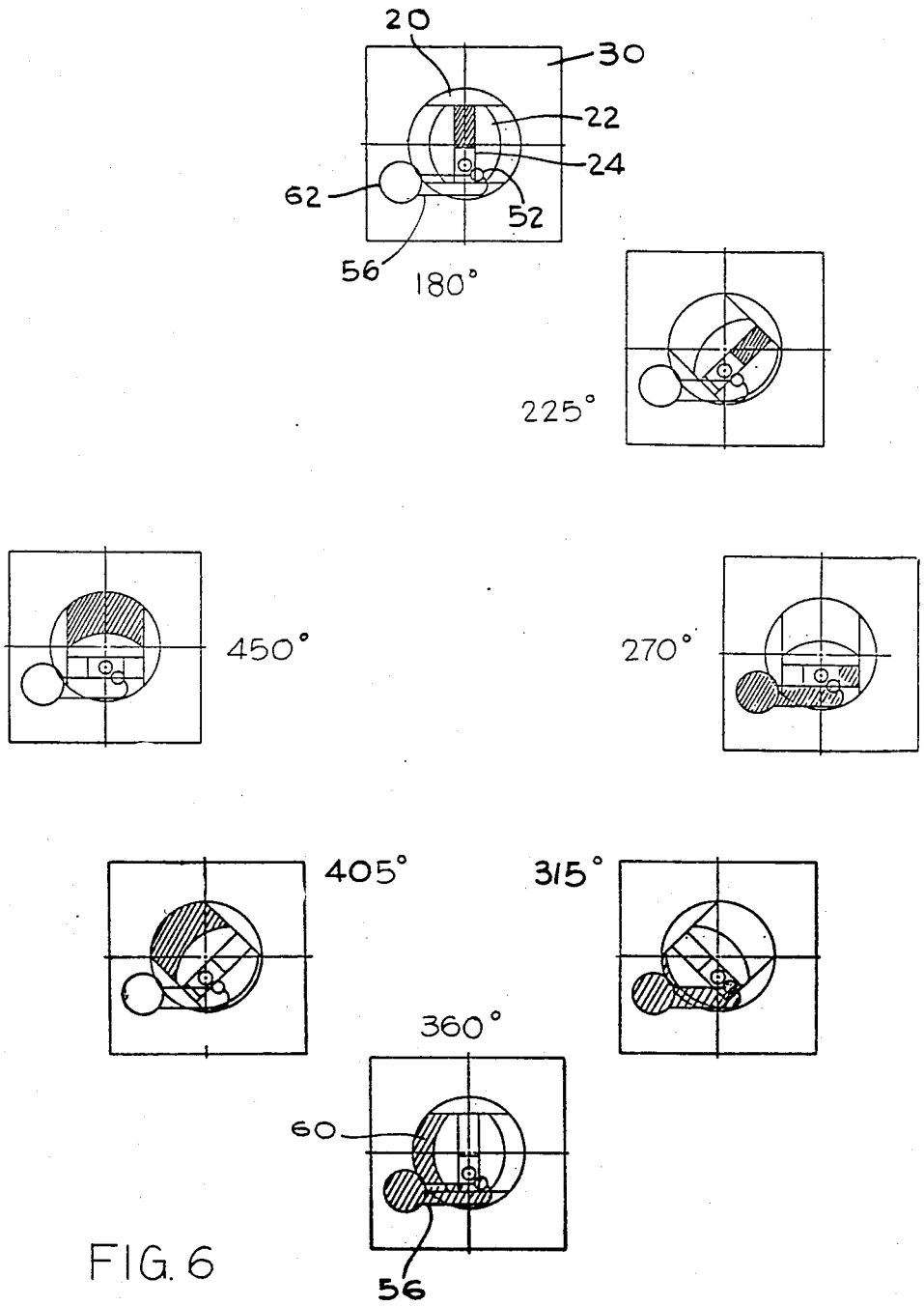
FIG. 6 is a sequence diagram in 90° increments of clockwise rotor rotation, showing operation of the fourth set of intermittently aligned ports.

FIG. 6 shows the operation of the fourth set of intermittently aligned ports, as seen from a vantage point within the transfer plate cover, in 45° increments of rotor rotation. A given volume of gas, illustrated by the cross-hatched area on each diagram, is shown being compressed between 180° and approximately 270° of rotor rotation, then being transferred past an ignition source and through the transfer plate passage 56 between approximately 270° and 360° of rotor rotation, while expanding against the piston crown throughout the interval from somewhat after 270° until 450° of rotor rotation. The large hole 62 connecting with the horizontal transfer passage 56 and penetrating the transfer plate in the lower left quadrant of each diagram comprises one half of the fourth set of ports, and the piston expansion space 60 itself constitutes the other half. It can be seen from FIG. 6 that the conjunction of these two mating cavities occurs soon after 270° (the approximate point at which the fuel/air mixture enters the transfer passage and is ignited), and continues until some point after 360° of rotor rotation. Both the limits and the duration of the conjunction of the fourth set of ports are determined by the size, shape and location of the large hole penetrating the transfer plate. An engine designer can specify these parameters so that the amount of hot pressurized gas admitted to the piston expansion space does not greatly exceed the quantity which can be expanded to ambient pressure after conjunction of the fourth set of ports has ended.

FIG. 2 shows the operation of the fifth set of intermittently aligned ports in permitting the fully expanded hot combustion products to be expelled from the engine at more or less ambient pressure. The 90° diagram illustrates the situation at 450° after shuttle intake, wherein conjunction of the rotor cross slot and the engine exhaust port connection 66 is just beginning. Conjunction involves little noise because the hot gases at 450° after shuttle intake are not at elevated pressure. Since the rotor cross slot and the engine exhaust port connection both subtend 90° arcs along the rotor periphery, their conjunction extends through 180° of rotor rotation to 630° after shuttle intake (also illustrated by the 90° diagram in FIG. 2), when all the hot gas has been expelled.

The interval from 0° (the beginning of shuttle intake) to 630° (the end of the piston exhaust stroke) is 90° less than two full revolutions of the rotor, because reciprocations of the shuttle and piston are 90° out of phase, and the gas mixture is therefore only compressed for 90° of rotation before the beginning of the piston power stroke.

ADVANTAGES OF THE INVENTION

For application as a hot gas engine, wherein the pressure of hot gaseous combustion products is applied directly to the expansion mechanism without substantial exchange of heat to another working fluid, or for application as a pneumatic power transmission system, or for a combination of these two applications, the invention addresses each of the shortcomings cited in the background section (above) for conventional internal combustion engines and their transmissions in the following ways:

INSENSITIVITY TO BURNING CHARACTERISTICS OF FUEL

Whereas slow-speed low-compression spark-ignition engines in heavy equipment in years past commonly ran quite efficiently on low octane gasoline or even kerosene, the demand for lighter, more powerful high-speed engines in automotive applications forced the development of high octane motor fuels which could evaporate and burn quickly enough to approach complete combustion during a power stroke of extremely short duration. These high octane fuels are more difficult to produce, more dangerous to store, and more expensive than their low-octane ancestors, and yet their use in conventional automotive engines has still resulted in the dispersal of huge quantities of unburned hydrocarbons and carbon monoxide, as well as toxic heavy metals along roadsides, parking lots, and garages throughout the world. There is sufficient latitude in design of the displacement sequence for the invention described here to permit temporary removal of the burning mixture from the displacement mechanism until combustion is complete and gas temperature is maximized, so that usefulness of the invention as a combustion engine is substantially independent of the burning characteristics of practically any available solid, liquid, or gaseous fuel.

EXPANSION TO AMBIENT PRESSURE DURING POWER STROKE

The idea of compounding the expansion of hot gas between a high-pressure cylinder of small displacement and a low-pressure cylinder of much larger displacement in order to minimize the unrecovered mechanical energy equivalent in the hot gas or vapor that is finally exhausted from an engine found common use in railroad steam locomotives of the previous century. Although such a compound engine is obviously more efficient than its uncompounded cousin, the increased weight, complexity, cost, and opportunity for heat loss during transfer, limit use of this approach to compressors and an occasional large stationary engine. The present invention, when used as the expansion mechanism for a hot gas engine comprising as few as three moving parts, approximates the benefits of compound operation for a four-cylinder four cycle engine of conventional design.

A LOAD-AVERAGING PNEUMATIC TRANSMISSION SYSTEM

Since any significant simplification of a conventional heat engine is likely to interfere with the engine's ability to adapt to sudden changes in speed and/or load, complete disclosure of a simplified heat engine, sized according to the average demand for power in a typical application, will require disclosure of a useful load-leveling transmission system as well. Since the invention described herein has straightforward application as a compressor or compressed gas motor, the combination of a compressor, a reservoir for storage of compressed gas, and one or more compressed gas motors constitutes such a load-leveling power transmission system. For example, the advantage of driving a vehicle by supply of compressed air through a flexible hose to an efficient air motor at each wheel, regardless of suspension motions or steering action of that wheel, will be particularly apparent to designers of lightweight and low-cost vehicles for either highway or off-the-road use.

USE OF CERAMIC MATERIALS IN COMBUSTION ENGINES

Processes for fabrication of extremely hard ceramic materials (e.g. silicon carbide, silicon nitride, alumina, zirconia, etc.) are being developed for the manufacture of parts for "adiabatic" high-temperature engines without cooling systems and with little or no lubrication. These materials can withstand much higher surface temperatures without galling or oxidation than any commonly used metal or alloy can endure. More or less conventional engine designs, fitted with ceramic cylinder liners, piston caps, and valves, are reportedly delivering efficiency improvements up to 50% by reducing heat conduction away from burning gases and by reducing viscous drag associated with movement of lubricating and cooling fluids. Most of this development has been done by people who aspire to supply these ceramic materials or parts in large quantity to engine manufacturers.

Ceramic materials, however, suffer from two serious deficiencies in engine part applications:

(1) They are difficult and expensive to fabricate to close tolerances, which discourages their use in multicylinder engines with hundreds of complex and accurately fitted moving parts, and (2) They tend to be shock sensitive, so that the possibility of uncontrolled detonation of fuel at any time during the life of an engine is likely to result in its catastrophic failure and a substantial risk of product liability claims against its manufacturer.

The extreme simplicity of the mechanism of this invention, the simple geometry of its parts, and the gradual nature of changes in displaced volume, serve to reduce the importance of these disadvantages of ceramic materials when applied to a low-cost lightweight adiabatic internal combustion engine.

What is claimed is:

1. A rotary displacement mechanism comprising: a housing having a bore therein; a rotor rotatably mounted in said bore, said rotor including a transverse slot; a piston slidably received in the transverse slot of said rotor and restrained from rotation relative to said rotor for reciprocating movement in the transverse slot of said rotor, said piston including a transverse slot; a shuttle slidably received in the transverse slot of said piston and restrained from rotation relative to said piston for reciprocating movement in the transverse slot of said piston; eccentric means for connecting said shuttle to said housing for rotation about an axis parallel to but fixedly offset from the axis of rotation of said rotor whereby said shuttle may slide in said transverse slot of said piston and said piston in said transverse slot of said rotor during rotation of said rotor relative to said housing; and porting means for enabling usage of the reciprocating piston as a first displacement mechanism and said reciprocating shuttle as a second displacement mechanism for compression or expansion of a gas passed therebetween by said porting means, said porting means including a first set of port means in said mechanism intermittently alignable during rotation of said rotor for allowing gas to pass from an intake passage in said housing through at least one passage in said rotor alternately to first spaces respectively displaced by opposite ends of said reciprocating shuttle, and a second set of port means in said mechanism intermittently alignable during rotation of said rotor for allowing gas to pass from said first spaces through at least one transfer passage in said housing to second spaces respectively displaced by opposite ends of said reciprocating piston.

2. The mechanism of claim 1, wherein said porting means enables utilization of the relative reciprocation of said shuttle within the transverse slot of said piston to meter a quantity of a gas and to compress the expel that quantity of gas into said at least one transfer passage and to said second spaces displaced by the reciprocation of said piston within the transverse slot of said rotor.

3. The mechanism of claim 1, for use as a compressed gas motor, wherein said porting means admission of a volume of compressed gas at an elevated pressure from said intake passage in said housing through said first set of port means alternately into said first spaces displaced by said shuttle, allowing the compressed gas to expand against the respective end of said shuttle and perform work on it, within the limits of its travel and displacement, after which the gas at somewhat less elevated pressure is then admitted, via said second set of port means and said at least one transfer passage, alternately to said second spaces defined by said piston having a greater displacement than said shuttle, after which the gas expands against and performs additional work on said piston, and from which second spaces the gas is expelled at near ambient pressure through a third set of intermittently alignable port means to an exhaust passage in said housing.

4. The mechanism of claim 1, for use as an expanding vapor engine, wherein said porting means enables vapor at elevated pressure from a boiler to be admitted via said first set of port means alternately into said first spaces displaced by said shuttle, so that the vapor performs work by expanding against the respective end of of said shuttle, within the limits of its travel and its displacement, after which the vapor at somewhat less elevated pressure is then admitted via said second set of port means and said at least one transfer passage alternately to said second spaces defined by said piston having a greater displacement than said shuttle, after which the vapor expands against the piston and performs work on it, and from which second spaces the vapor is expelled through a third set of intermittently alignable port means to an exhaust passage in said housing.

5. The mechanism of claim 1, including a third set of intermittently alignable port means for expelling gas alternately from said second spaces to an exhaust passage in said housing, and wherein the phase relationship between intermittent alignment of said second set of port means and intermittent alignment of said third set of port means is such that said second spaces are each in communication with a first space only when not in communication with said exhaust passage.

6. The mechanism of claim 1, wherein said engine intake passage has a port opening to said bore, and said first set of port means includes a pair of outer ports in said rotor opening externally thereof and being alternately intermittently alignable with said port of said intake passage during rotation of said rotor for passage of gas.

7. The mechanism of claim 6, including a pair of inner ports in said rotor opening to the transverse slot of said rotor and respectively connected by passages in said rotor to said outer ports, and a pair of ports in said piston opening externally thereof and being intermittently alternately alignable with said inner ports during reciprocating movement of said piston.

8. The mechanism of claim 7, wherein said inner ports are located at the floor of the transverse slot of said rotor and said ports in said piston are located at a surface of said piston sliding on said floor of said slot.

9. A rotary displacement mechanism comprising: a housing having a bore therein; a rotor rotatably mounted in said bore, said rotor including a transverse slot; a piston slidably received in the transverse slot of said rotor and restrained from rotation relative to said rotor for reciprocating movement in the transverse slot of said rotor, said piston including a transverse slot; a shuttle slidably received in the transverse slot of said piston and restrained from rotation relative to said piston for reciprocating movement in the transverse slot of said piston; eccentric means for connecting said shuttle to said housing for rotation about an axis parallel to but fixedly offset from the axis of rotation of said rotor whereby said shuttle may slide in said transverse slot of said piston and said piston in said transverse slot of said rotor during rotation of said rotor relative to said housing; and porting means for enabling usage of the reciprocating piston as a first displacement mechanism and said reciprocating shuttle as a second displacement mechanism for compression or expansion of a gas passed therebetween by said porting means, said porting means including a first set of port means in said mechanism intermittently alignable during rotation of said rotor for allowing gas to pass from an intake passage in said housing through at least one passage in said rotor alternately to a first space displaced by an end of said reciprocating shuttle, and a second set of port means in said mechanism intermittently alignable during rotation of said rotor for allowing gas to pass from said first space through at least one transfer passage in said housing to a second space displaced by an end of said reciprocating piston.

10. The mechanism of claim 9, including a third set of intermittently alignable port means for expelling gas from said second space to an exhaust passage in said housing, and wherein the phase relationship between intermittent alignment of said second set of port means and intermittent alignment of said third set of port means is such that said second space is in communication with said first space only when not in communication with said exhaust passage.

11. The mechanism of claim 9, wherein said engine intake passage has a port opening to said bore, and said first set of port means includes an outer port in said rotor opening externally thereof and being alternately intermittently alignable with said port of said intake passage during rotation of said rotor for passage of gas.

12. The mechanism of claim 11, including an inner port in said rotor opening to the transverse slot of said rotor and connected by a passage in said rotor to said outer port, and a port in said piston opening externally thereof and being intermittently alternately alignable with said inner port during reciprocating movement of said piston.

13. The mechanism of claim 12, wherein said inner port is located at the floor of the transverse slot of said rotor and said port in said piston is located at a surface of said piston sliding on said floor of said slot.

* * * * *